US010253554B2

(12) United States Patent
Caglin et al.

(10) Patent No.: US 10,253,554 B2
(45) Date of Patent: Apr. 9, 2019

(54) HOME APPLIANCE DEVICE COMPRISING A DOOR AND HOME APPLIANCE DEVICE

(71) Applicant: BSH HAUSGERAETE GMBH, Munich (DE)

(72) Inventors: Muharrem Uemit Caglin, Istanbul (TR); Semih Cakil, Istanbul (TR); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/360,200

(22) Filed: Nov. 23, 2016

(65) Prior Publication Data

US 2018/0142940 A1 May 24, 2018

(51) Int. Cl.

| | |
|---|---|
| ***E06B 3/70*** | (2006.01) |
| ***E06B 7/02*** | (2006.01) |
| ***E06B 7/28*** | (2006.01) |
| ***E06B 7/14*** | (2006.01) |
| ***F25D 17/04*** | (2006.01) |

(52) U.S. Cl.

CPC ..... *E06B 3/70* (2013.01); *E06B 7/02* (2013.01); *E06B 7/14* (2013.01); *E06B 7/28* (2013.01); *F25D 17/047* (2013.01); *E06B 2003/7051* (2013.01)

(58) Field of Classification Search

CPC ..... F25D 23/02; F25D 17/045; F25D 17/047

See application file for complete search history.

(56) References Cited

U.S. PATENT DOCUMENTS

| | | | | |
|---|---|---|---|---|
| 2009/0199588 | A1* | 8/2009 | Laible | F16K 15/141 62/449 |
| 2011/0023532 | A1* | 2/2011 | Kobayashi | F25B 9/006 62/498 |
| 2015/0030800 | A1* | 1/2015 | Jung | B32B 7/12 428/69 |

FOREIGN PATENT DOCUMENTS

DE 102006040381 A1 3/2008

* cited by examiner

*Primary Examiner* — Keith Raymond
*Assistant Examiner* — Nael Babaa
(74) *Attorney, Agent, or Firm* — Laurence A. Greenberg; Werner H. Stemer; Ralph E. Locher

(57) ABSTRACT

For the purpose of improving a usability, a home appliance door, in particular a home chiller appliance door, is proposed: The home appliance door has an inner wall section; an outer wall section; a valve connecting the inner wall section and the outer wall section; and a cover element which is separate from and fixed to the valve and at least partly covers the inner wall section.

14 Claims, 2 Drawing Sheets

HOME APPLIANCE DEVICE COMPRISING A DOOR AND HOME APPLIANCE DEVICE

BACKGROUND OF THE INVENTION

The invention relates to a home appliance door, in particular a home chiller appliance door.

DE 10 2006 040 381 A1 discloses a home appliance door which comprises an inner wall section, an outer wall section, and a valve connecting the inner wall section and the outer wall section.

SUMMARY OF THE INVENTION

An objective of the invention is, in particular, to provide a home appliance device with improved characteristics regarding usability. This objective is achieved, according to the invention, while further implementations and further developments of the invention may be gathered from the dependent claims.

A home appliance door, for example a home chiller appliance door, is proposed, comprising: an inner wall section; an outer wall section; a valve connecting the inner wall section and the outer wall section; and a cover element which is separate from and fixed to the valve and at least partly covers the inner wall section, in particular viewed in a direction that is at least substantially perpendicular to a main extension of the inner wall section.

By means of the invention in particular a usability of the home appliance device can be improved. Preferably sharp edges of the inner wall section and/or the valve may be covered by the cover element whereby a user's safety can be increased. Advantageously, hygiene of the home appliance door can be improved as the cover element can prevent clogging of the valve, in particular by debris and/or condensed water.

In this context, "configured" is in particular to mean specifically programmed, designed and/or equipped. By an object being configured for a certain function is in particular to be understood that the object implements and/or fulfills said certain function in at least one application state and/or operating state.

The home appliance door is in particular part of a home appliance device, in particular a home chiller appliance device. A "home appliance device" is in particular to be understood as a portion, preferably a sub-assembly group, of a home appliance. The home appliance is, in this context, in particular provided for storing and preferably tempering victuals such as beverages, in particular alcoholic beverages such as wine, meat, fish, vegetables, fruits, milk and/or dairy products in at least one operating state, advantageously for the purpose of enhancing a quality and/or a storage life of the stored victuals. For example, the home appliance is embodied as a home chiller appliance, which is in at least one operating state configured for cooling victuals. The home chiller appliance could in particular be embodied as a climate cabinet, an ice-box, a wine-cooler, a freezer and/or a refrigerator-freezer combination. For example, the home chiller appliance is embodied as a refrigerator. However, the home appliance could also be embodied as a home appliance for warming and in particular for cooking victuals, e.g. an oven, a cooker and/or a microwave. The home appliance device comprises in particular a housing, which preferably defines a storage space of the home appliance device. The storage space is in particular a space inside the home appliance device, which is provided for storing victuals.

The home appliance door may comprise in particular a door housing. The door housing may comprise the inner wall section and the outer wall section, which together at least partly delimit an interior space of the door housing. The interior space may at least partly or at least mostly or entirely be filled with an insulating means, in particular a foam, for example a polymer foam, e.g. a polyurethane foam.

The term "at least mostly" with reference to an object is in particular to mean by more than 50% or by more than 65% or by more than 80% or by more than 95% of an object, in particular of a surface area and/or of a volume and/or of a mass of the object. In a closed state of the home appliance door the inner wall section may in particular be a wall section of the door housing which faces towards the storage space and which preferably at least partly delimits the storage space. In a closed state of the home appliance door, the outer wall section may in particular be a wall section of the housing which faces away from the storage space and which for example at least partly embodies a front face of the home appliance door. The inner wall section and/or the outer wall section may each comprise in particular at least one air opening which allows an air flow at least between the storage space and an environment of the home appliance door, e.g. through the interior space.

The home appliance door may in particular comprise at least one or at least two or a plurality of further valves deemed advantageous by someone skilled in the art, which are in particular embodied equivalently to the valve. The description regarding the valve is in particular also applicable to the further valves.

The valve may be embodied as a check valve. The valve may in particular be a vacuum release valve, which is configured for reducing a door opening force against an external pressure and/or preferably for drainage of condensation water. For example the valve comprises an air duct, which at least partly or at least mostly or entirely extends through the interior space and which may be adjacent to the air openings of the inner wall section and/or of the outer wall section. The cover element may at least partly cover the valve. The cover element may at least partly or at least mostly or entirely cover the air duct of the valve. The valve may comprise in particular a seal that is configured to allow airflow between the storage space and the environment of the home appliance door for adjusting a pressure ration between the storage space and the environment. The seal may in particular be arranged inside the air duct.

The home appliance door may in particular comprise at least one or at least two or a plurality of further cover elements deemed advantageous by someone skilled in the art, for example one for each further valve, which are in particular embodied equivalently to the cover element. The description regarding the cover element is in particular also applicable to the further cover elements.

In this context, the cover element "being separate" is in particular to mean that the cover element is a further part of the home appliance door and/or not integrally implemented with the valve. "Implemented integrally" is in particular to mean, in this context, connected at least by substance-to-substance bond, e.g. by a welding process, an adhesive bonding, an injection-molding process and/or by another process that is deemed expedient by a person having ordinary skill in the art. Advantageously, "implemented integrally" could in particular mean made of one piece. "Made of one piece" is in particular to mean, in this context, manufactured from one single piece, e.g. by production from one single cast and/or by manufacturing in a one-component or multi-component injection-molding process, and advantageously from a single blank. A main extension of the cover element is in particular at least substantially parallel to a main extension of the inner wall section. A "main extension" of an object is, in particular, to be understood as a largest extension of an imaginary rectangular cuboid which only just entirely encloses the object and preferably extends through a geometric center of the object. In this context "at least substantially parallel" is in particular to be understood as an orientation of a direction with respect to a reference direction, in particular in a plane, wherein the direction and the reference direction include an angle of 0°, the orientation in particular having a deviation of less than 15°, advantageously of less than 10° and particularly advantageously of less than 2°.

In this context, the term "fixed" is in particular to be understood as releasably and/or toollessly fixed.

It is further proposed that the cover element may cover in particular the inner wall section in a vicinity of the air opening of the inner wall section, in particular viewed in a direction that is at least substantially perpendicular to a main extension of the inner wall. In this context, a "vicinity" is in particular to be understood as a circular area around the air opening having a radius of at most 10 cm or of at most 5 cm or of at most 2 cm. In this context, "at least substantially perpendicular" is in particular to be understood as an orientation of a direction with respect to a reference direction, in particular in a plane, wherein the direction and the reference direction include an angle of 90°, the orientation having in particular a deviation of less than 15° or of less than 10° or of less than 2°.

Further, it is proposed that the cover element may at least partly or at least mostly or entirely cover the valve, in particular viewed in a direction that is at least substantially perpendicular to a main extension of the inner wall section. As a result of this, a usability can be increased as clogging of the valve by debris and/or condensed water can be avoided.

For the purpose of improving a design, it is proposed that the inner wall section may comprise an inner liner and a cover sheet which at least partly or at least mostly or entirely covers the inner liner, in particular viewed at least substantially perpendicular to the main extension of the inner wall section. The cover sheet is in particular at least section-wise in direct contact with the inner liner. The cover sheet may in particular at least partly deformable. In this context, "deformable" is in particular to be understood as the ability of an object to be deformed, in particular elastically deformed, preferably reversibly deformed and advantageously repeatedly reversibly deformed, in particular due to its shape and/or to a material of which it is made. The cover sheet may in particular at least partly or at least mostly or entirely made of a deformable material. In this context, a "deformable material" is in particular to mean a material having an elastic modulus of at most 10 GPa or at most 5 GPa or of at most 1 GPa or of at most 0.1 GPA. The cover sheet may in particular at least partly or at least mostly or entirely made of metal. For example the cover sheet is made of sheet metal. The inner liner may in particular be at least partly or at least mostly or entirely made of plastic, in particular a thermoplastic. Alternatively or additionally the inner liner may be at least partly or at least mostly or entirely made of metal.

Furthermore, it is proposed that the inner liner and the cover sheet may delimit a side space inside which the valve and/or the cover element are/is at least partly arranged. The inner liner and the cover sheet may delimit the side space in particular in a vicinity of the air opening of the inner wall section. The side space may in particular be separated from the storage space by means of the cover sheet. The side space may in particular separated from the interior space by means of the inner liner. The inner liner and/or the cover sheet may comprise in particular a bulge in a vicinity of the air opening of the inner wall section, which can be provided for enlarging the side space. As a result of this, in particular a separate assembly space for the cover element and the valve can be provided. Advantageously, a flush design can be achieved.

In a further implementation of the invention it is proposed that the home appliance door may comprise a fixing unit, which has at least one or at least two or a plurality of first fixing elements and at least one or at least two or a plurality of corresponding second fixing element/s cooperating with the first fixing element/s for fixing the cover element to the valve at least in a form-fit manner and preferably additionally in a force-fit manner. By the term "fixing in a force-fit and/or form-fit manner" is in particular to be understood for example releasably fixed, wherein a holding force between two structural components is preferably transferred via a geometric engagement of the structural components with each other and/or preferably via a friction force acting between the structural components. Alternatively or additionally a connection may be provided by substance-to-substance bond, preferably an adhesive and/or cohesive connection. The fixing unit is in particular embodied as a quick mount and/or a snap mount and/or a bayonet mount. In particular the first fixing element and/or the second fixing element are/is deformable. The first fixing element may in particular be embodied as a snap nose which the first fixing element at least partly may snap into. The second fixing element is in particular embodied as a, for example deformable, snap hook. In particular, the second fixing element may be embodied as a snap-receiver receiving the entire first fixing element, which may be embodied as a snap hook. Alternatively, the first fixing element and the second fixing element may be both embodied as corresponding fixing hooks which snap into each other. As a result of this, in particular an assembly and/or disassembly can be simplified and may be carried out without the use of tools.

In a further implementation of the invention it is proposed that the fixing unit may be arranged at least partly or at least mostly or entirely inside the side space. In particular, the first fixing element and the second fixing element may be arranged inside the side space. As a result of this, in particular a compact arrangement of the fixing unit may be achieved. Advantageously, a required installation space can be reduced.

In addition, it is proposed that the valve may at least partly embody the first fixing element. Alternatively, the valve at least partly may embody the second fixing element. The valve, in particular the air duct, may comprise in particular a protrusion which may embody the first fixing element. Further the cover element may comprise a first protrusion which may embody the second cover element. In particular the first cover element may comprise a second protrusion which may embody the first fixing element. In particular, the first fixing element and/or the second fixing element may extend/extends at least partly or at least mostly or entirely around a circumference of the valve and/or of the cover element. As a result, further components for fixing the cover element to the valve can be avoided. In particular an installation space can be further reduced.

For the purpose of improving a fixation, it is further proposed that the inner wall section, in particular the cover sheet and the inner liner may be in a fixed state in which the cover element is fixed to the valve, arranged at least partly between the cover element and the valve. The cover element and the valve in particular apply a fixing force onto the cover sheet and the inner liner from two, for example antiparallel, directions. In particular, the inner wall section may, in a fixed state in which the cover element is fixed to the valve, at least partly deformed by the cover element and/or the valve, preferably by the fixing force.

For the purpose of improving an air flow it is proposed, that the cover element may comprise at least one or at least two or a plurality of air opening/s. The air opening may in particular extend over a whole diameter of the valve. The air opening may in particular be shaped annularly. The air opening, in particular the air openings, may be arranged least partly concentrically with respect to at least one symmetry axis of the cover element. Furthermore, the air openings may in particular be arranged concentrically with respect to each other. Advantageously a size of an air opening depends on its distance from the symmetry axis of the cover element. The size may increase with increasing distance. As a result of this, in particular a sufficient air flow can be provided while avoiding clogging of the valve.

Herein the home appliance device is not to be limited to the application and implementation described above. In particular, for the purpose of fulfilling a functionality herein described, the home appliance device may comprise a number of respective elements, structural components and units that differs from the number mentioned herein. Furthermore, regarding the value ranges mentioned in this disclosure, values within the limits mentioned are to be understood to be also disclosed and to be used as applicable.

Further advantages may become apparent from the following description of the drawing. In the drawing exemplary embodiments of the invention are shown. The drawing, the description and the claims contain a plurality of features in combination. The person having ordinary skill in the art will purposefully also consider the features separately and will find further expedient combinations.

If there is more than one specimen of a certain object, only one of these is given a reference numeral in the figures and in the description. The description of this specimen may be correspondingly transferred to the other specimens of the object.

DETAILED DESCRIPTION OF THE INVENTION

Figure 1:
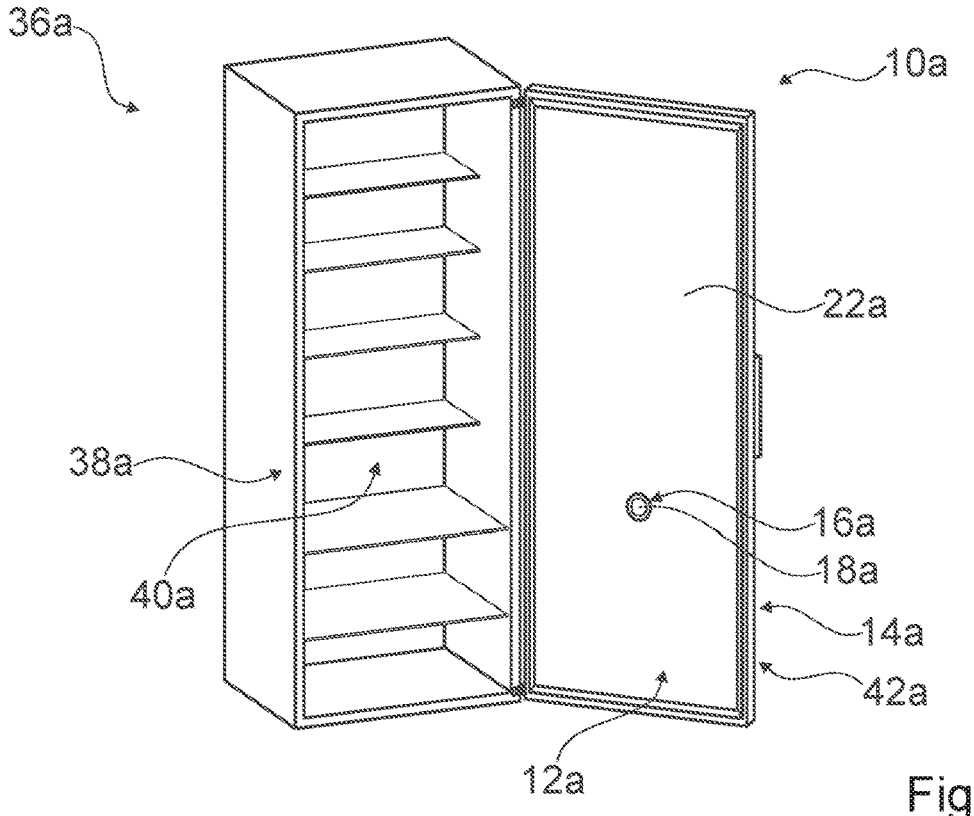
FIG. 1 a home appliance comprising a home appliance device, in a schematic perspective view, FIG. 2 a portion of the home appliance device comprising a home appliance door, in a cross-sectional view, FIG. 3 a portion of the home appliance device, comprising a fixing unit, in a cross-sectional view, and FIG. 4 an alternative home appliance device comprising a home appliance door, in a cross-sectional view.

FIG. 1 shows a home appliance 36*a* comprising a home appliance device, in a schematic perspective view. The home appliance 36*a* is embodied as a refrigerator. The home appliance 36*a* could further be embodied as any other home appliance deemed advantageous by someone skilled in the art, e.g. a climate cabinet, an ice-box, a freezer, a wine-cooler and/or a refrigerator-freezer combination.

The home appliance device comprises a housing 38*a*. The home appliance device comprises a home appliance door 10*a*. The housing 38*a* and the home appliance door 10*a* delimit a storage space 40*a* in a closed state of the home appliance door 10*a*.

The home appliance door 10*a* comprises a door housing 42*a*. The door housing 42*a* comprises an inner wall section 12*a*. The inner wall section 12*a* is a wall section of the door housing 42*a* which faces towards the storage space 40*a*. In a closed state of the home appliance door 10*a*, the inner wall section 12*a* at least partly delimits the storage space 40*a*. In the closed state of the home appliance door 10*a*, an outer wall section 14*a* is a wall section of the door housing 42*a* which faces away from the storage space 40*a*. The outer wall section 14*a* at least partly embodies a front of the home appliance door 10*a*. The inner wall section 12*a* and the outer wall section 14*a* together delimit an interior space 44*a* of the door housing 42*a*. The interior space 44*a* is at least partly filled with an insulating means. The insulating means is a foam, preferably a polymer foam, advantageously a polyurethane foam.

The inner wall section 12*a* comprises at least one air opening 46*a*. The outer wall section 14*a* comprises at least one further air opening 48*a*. The air openings 46*a*, 48*a* allow an air flow through the interior space 44*a* and preferably at least between the storage space 40*a* and an exterior of the home appliance device.

The inner wall section 12*a* comprises an inner liner 20*a*. The inner liner 20*a* is preferably at least partly made of plastic, in particular a thermoplastic. The inner wall section 12*a* comprises a cover sheet 22*a*. The cover sheet 22*a*t is at least partly made of metal. The cover sheet 22*a* is made of sheet metal. The cover sheet 22*a* at least partly covers the inner liner 20*a*, in particular viewed in a direction that is at least substantially perpendicular to a main extension of the inner wall section 12*a*. The cover sheet 22*a* is in contact with and/or covers most of a surface area of the inner liner 20*a*. The cover element 22*a* covers the inner wall section 12*a* in a vicinity of the air opening 46*a* of the inner wall section 12*a*, in particular viewed in a direction that is at least substantially perpendicular to a main extension of the inner wall section 12*a*. The inner liner 20*a* and the cover sheet 22*a* delimit a side space 24*a*. The inner liner 20*a* and the cover sheet 22*a* delimit the side space 24*a* in a vicinity of the air opening 42*a* of the inner wall section 12*a*. The side space 24*a* is separated from the storage space 40*a* and/or the interior space 44*a* at least by the inner wall section 12*a*. The inner liner 20*a* comprises a bulge, which delimits the side space 24*a*. The bulge is arranged in a vicinity of the air opening 46*a* of the inner wall section 12*a*. Alternatively or additionally the cover sheet 22*a* may comprise a bulge which at least partly delimits the side space 24*a*.

The home appliance door 10*a* comprises a valve 16*a*. The valve 16*a* is embodied as a check valve. The valve 16*a* is configured to reduce a door opening force against an external pressure and/or preferably for drainage of condensation water. The valve 16*a* connects the inner wall section 12*a* and the outer wall section 14*a*. The valve 16*a* is at least partly arranged inside the side space 24*a*. The valve 16*a* comprises an air duct 50*a*. The air duct 50*a* is adjacent to the air openings 46*a*, 48*a*. The air duct 50*a* extends at least mostly through the interior space 44*a*.

The valve 16*a* comprises a sealing unit 52*a*. The sealing unit 52*a* seals the valve 16*a* with the inner wall section 12*a*. The sealing unit 52*a* prevents the insulation means which the interior space 44*a* is filled with from flowing into the valve 16*a*. The sealing unit 52*a* is at least partly embodied by the air duct 50*a*. The valve 16*a* comprises a further sealing unit 54*a*. The further sealing unit 54*a* seals the valve 16*a* with the outer wall section 14*a*. The further sealing unit 54*a* prevents foam which the interior space 44*a* is filled with from floating into the valve 16*a*. The valve 16*a* comprises a shell 56*a*. The shell 56*a* at least partly embodies the further sealing unit 54*a*. For sealing of the valve 16*a*, the air duct 50*a* is at least partly inserted into the shell 56*a*.

The valve 16*a* comprises a seal (not shown) which depending on a pressure ratio between the storage space 40*a* and an environment allows an air flow through the valve 16*a*. The seal is at least partly arranged inside the air duct 50*a*.

The home appliance door 10*a* comprises a cover element 18*a*. The cover element 18*a* comprises at least one air opening 32*a*. The cover element 18*a* is separate from the valve 16*a*. The cover element 18*a* at least partly covers the inner wall section 12*a*, preferably the cover sheet 22*a* of the inner wall section 12*a*, in particular viewed in a direction that is at least substantially perpendicular to a main extension of the inner wall section 12*a*.

The home appliance door 10*a* comprises a fixing unit 26*a*. By means of the fixing unit 26*a* the cover element 18*a* is fixed to the valve 16*a*. The fixing unit 26*a* is embodied as a quick mount. In the present case the fixing unit 26*a* is embodied as a snap mount. Alternatively or additionally the fixing unit 26*a* may be embodied as a bayonet mount. The fixing unit 26*a* comprises at least one first fixing element 28*a*. The fixing unit 26*a* comprises at least one corresponding second fixing element 30*a*. The second fixing element 30*a* cooperates with the first fixing element 28*a* for fixing the cover element 22*a* to the valve 16*a* at least in a form-fit manner. Further the second fixing element 30*a* cooperates with the first fixing element 28*a* for fixing the cover element 22*a* to the valve 16*a* at least in a force-fit manner. The first fixing element 28*a* and/or the second fixing element 30*a* are/is deformable. The first fixing element 28*a* is embodied as snap nose. The second fixing element 30*a* is in particular embodied as a snap hook. When the cover element 18*a* is fixed to the valve 16*a*, the second fixing element 30*a* snaps into the first fixing element 28*a*. Alternatively or additionally the second fixing element 30*a* may be embodied as a snap-receiver which receives the entire first fixing element 28*a*. It is also conceivable that the first fixing element 28*a* and the second fixing element 30*a* may be both embodied as corresponding snap hooks which snap into each other.

The fixing unit 26*a* is arranged at least partly inside the side space 24*a*. In particular, the first fixing element 28*a* and the second fixing element 30*a* are arranged inside the side space 24*a*. The valve 16*a* at least partly embodies the first fixing element 28*a*. The first fixing element 28*a* extends at least partly, preferably at least mostly and advantageously entirely around a circumference of the valve 16*a*. The valve 16*a*, in particular the air duct 50*a* of the valve 16*a*, comprises a first protrusion which embodies the first fixing element 28*a*. The cover element 18*a* at least partly embodies the second fixing element 30*a*. The second fixing element 30*a* extends at least partly, preferably at least mostly and advantageously entirely around a circumference of the cover element 18*a*. Further the cover element 18*a* comprises a protrusion which embodies the second fixing element 30*a*.

The inner wall section 12*a* is, in a fixed state in which the cover element 18*a* is fixed to the valve 16*a*, arranged at least partly between the cover element 18*a* and the valve 16*a*. The cover element 18*a* and the valve 16*a* apply a fixing force onto the cover sheet 22*a* and the inner liner 20*a* from two, preferably antiparallel, directions. The inner wall section 12*a* is, in a fixed state in which the cover element 18 is fixed to the valve 16*a*, at least partly deformed by the cover element 18*a* and/or the valve 16*a*. In a vicinity of the air opening 46*a* of the inner wall section 12*a*, the cover sheet 22*a* is bent by the applied fixing force.

Figure 2:
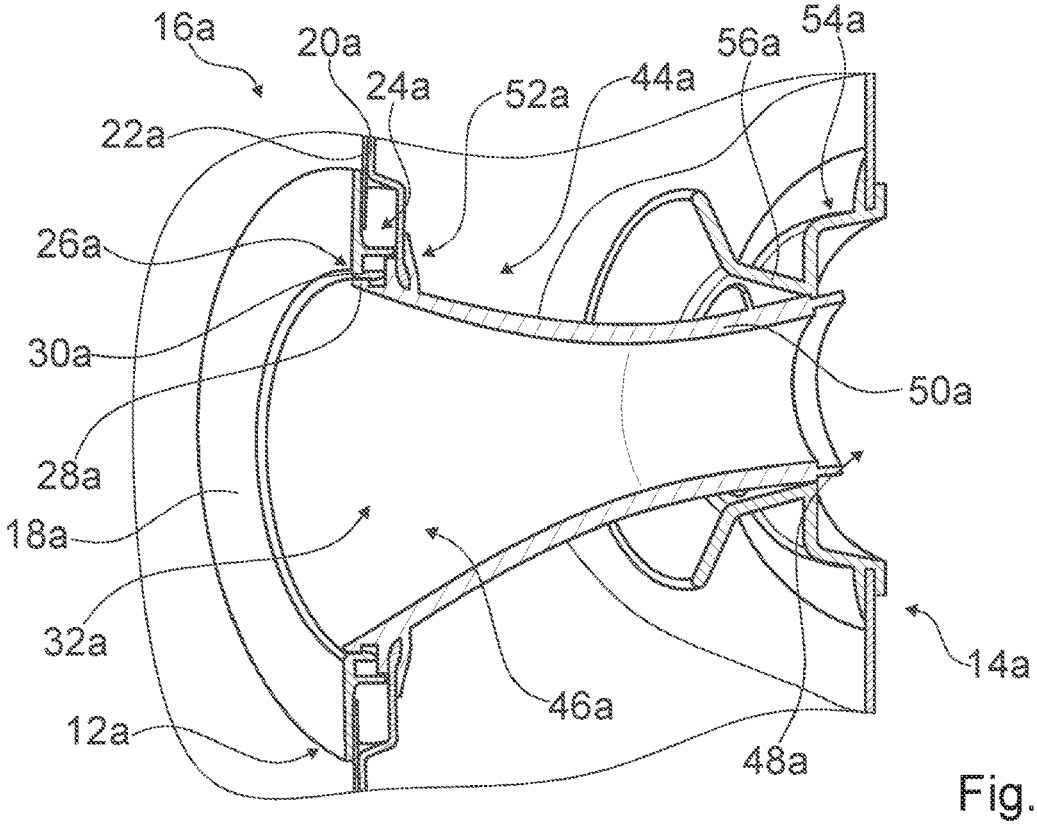
Figure 3:
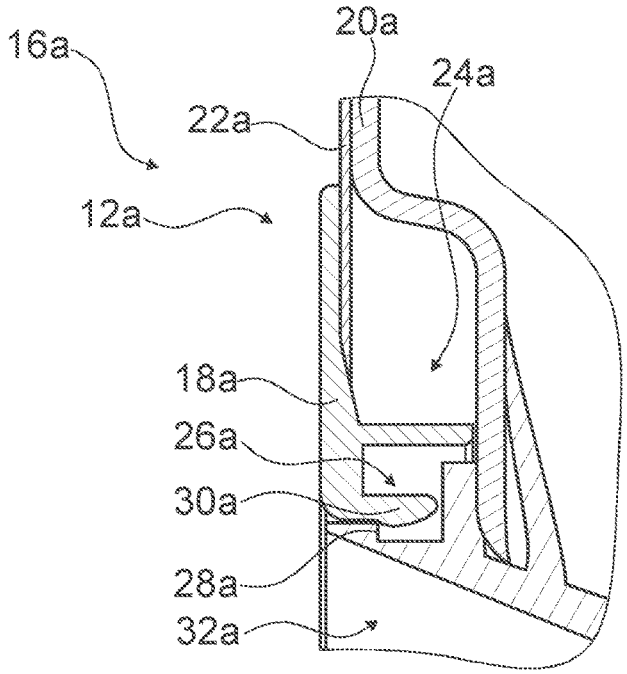
Figure 4:
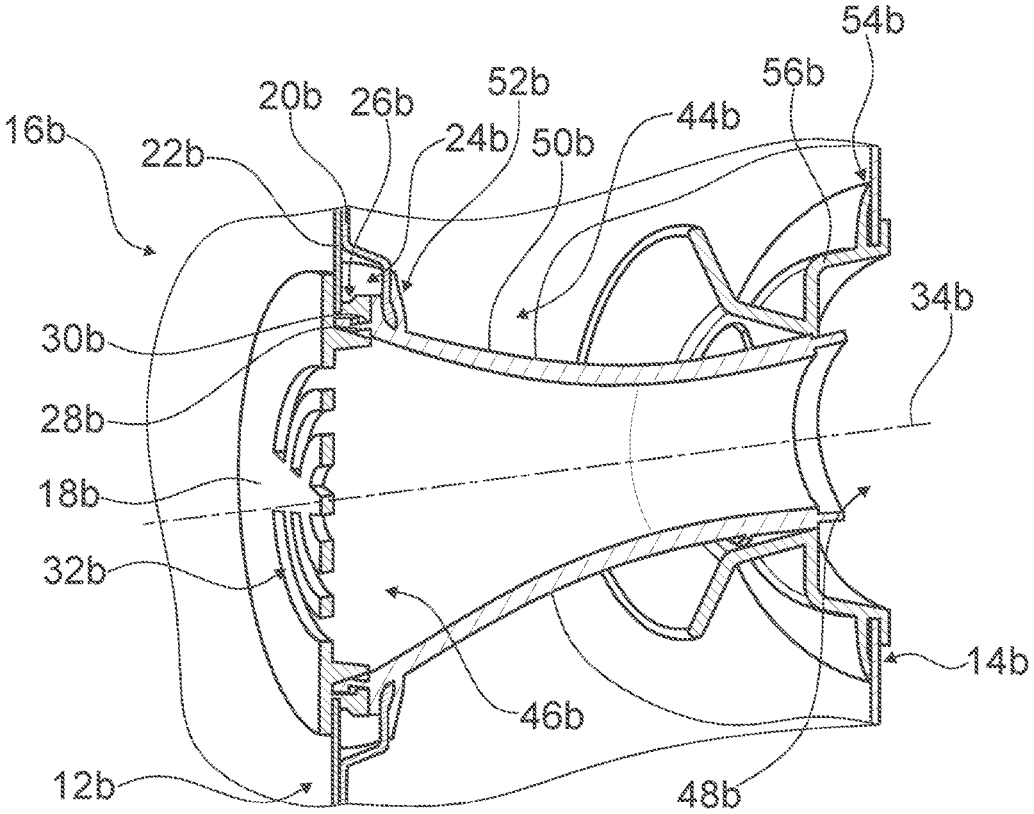

FIG. 4 shows an alternative exemplary embodiment of the invention. The following description is substantially limited to the differences between the exemplary embodiments, wherein regarding structural elements, features and functions that remain the same the description of the other exemplary embodiment, in particular of FIGS. 1 to 3, may be referred to. For distinguishing the exemplary embodiments, the letter a of the reference numerals in the exemplary embodiment of FIGS. 1 to 3 has been substituted by the letter b in the reference numerals of the exemplary embodiments of FIG. 4. Regarding structural elements having the same denomination, in particular regarding structural elements having the same reference numerals, principally the drawing and/or the description of the other exemplary embodiment, in particular of FIGS. 1 to 3, may be referred to.

FIG. 4 shows a portion of an alternative home appliance device comprising a home appliance door 10*b*, in a cross-sectional view. The exemplary embodiment of FIG. 4 differs from the preceding exemplary embodiment at least substantially by the implementation of a cover element 18*b* of the home appliance door 10*b*. In the present case the cover element 18*b* at least partly covers a valve 16*b* of the home appliance door 10*b*.

The cover element 18*b* comprises a plurality of air openings 32*b*. The air openings 32*b* of the cover element 18*b* are arranged least partly concentrically with respect to at least one symmetry axis 34*b* of the cover element 18*b*. Furthermore, the air openings 32*b* are arranged concentrically with respect to each other.

The home appliance door 10*b* comprises a fixing unit 26*b*. The fixing unit 26*b* comprises a first fixing element 28*b*. The fixing unit 26*b* comprises a second fixing element 30*b*. In the present case the second fixing element 30*b* is embodied as a snap-receiver. The second fixing element 30*b* receives the entire first fixing element 28*b* of the fixing unit 30*b*.

REFERENCE NUMERALS

10 Home appliance door
12 Inner wall section
14 Outer wall section
16 Valve
18 Cover element
20 Inner liner
22 Cover sheet
24 Side space
26 Fixing unit
28 First fixing element
30 Second fixing element
32 Air opening
34 Symmetry axis
36 Home appliance
38 housing
40 Storage space
42 Door housing
44 Interior space
46 Air opening
48 Further air opening
50 Air duct
52 Sealing unit
54 Further sealing unit
56 Shell

The invention claimed is:

1. A home appliance door, comprising:

an inner wall section;

an outer wall section;

a valve connecting the inner wall section and the outer wall section, the valve including an air duct extending at least mostly through an interior space defined between the outer wall section and the inner wall section; and a cover being releasably fixed to the air duct of the valve for being separable from the inner wall section, the cover at least partly covering the inner wall section.

2. The home appliance door according to claim 1, wherein the cover at least partly covers the valve.

3. The home appliance door according to claim 1, wherein the inner wall section includes an inner liner and a cover sheet which at least partly covers the inner liner.

4. The home appliance door according to claim 3, wherein the inner liner and the cover sheet delimit a side space inside which the valve and/or the cover are/is at least partly arranged.

5. A home appliance door comprising:

an inner wall section;

an outer wall section;

a valve connecting the inner wall section and the outer wall section, the valve including an air duct extending at least mostly through an interior space defined between the outer wall section and the inner wall section; and a cover being separate from and being releasably fixed to the air duct of the valve for being separable from the inner wall section and said cover at least partly covering the inner wall section;

a fixing unit having at least one first fixing element and at least one corresponding second fixing element cooperating with the first fixing element for fixing the cover to the valve at least in a form-fit manner.

6. The home appliance door according to claim 5, wherein the fixing unit is arranged at least partly inside the side space.

7. The home appliance door according to claim 5, wherein the valve at least partly embodying embodies the first fixing element.

8. The home appliance door according to claim 5, wherein the cover at least partly embodies the second fixing element.

9. The home appliance door according to claim 1, wherein the inner wall section is arranged, in a fixed state in which the cover is fixed to the valve, at least partly between the cover and the valve.

10. The home appliance door according to claim 1, wherein the inner wall section is, in a fixed state of the cover in which the cover is fixed to the valve, deformed by the cover and/or the valve.

11. The home appliance door according to claim 1, wherein the cover includes at least one air opening.

12. The home appliance door according to claim 11, wherein the at least one air opening is arranged concentrically with respect to at least one symmetry axis of the cover element.

13. A home appliance device comprising a home appliance door according to claim 1.

14. A home appliance comprising a home appliance device according to claim 13.

* * * * *